United States Patent [19]

Tatsuoka et al.

[11] 4,354,358

[45] Oct. 19, 1982

[54] OPEN-CYCLE TYPE AIR CONDITIONER

[75] Inventors: Masao Tatsuoka; Katsunori Fujimura, both of Nara, Japan

[73] Assignee: Sharp Kabushiki Kaisha, Osaka, Japan

[21] Appl. No.: 228,202

[22] Filed: Jan. 26, 1981

[30] Foreign Application Priority Data

| | | | |
|---|---|---|---|
| May 26, 1980 | [JP] | Japan | 55-73069[U] |
| Jul. 29, 1980 | [JP] | Japan | 55-104543 |
| Jul. 29, 1980 | [JP] | Japan | 55-104544 |

[51] Int. Cl.[3] ..... F25D 23/00

[52] U.S. Cl. ..... 62/271

[58] Field of Search ..... 62/271

[56] References Cited

U.S. PATENT DOCUMENTS

| | | | |
|---|---|---|---|
| 2,926,502 | 3/1960 | Munters et al. | 62/271 X |
| 2,968,165 | 1/1961 | Norback | 62/271 X |
| 3,009,540 | 11/1961 | Munters | 55/34 |
| 3,144,901 | 8/1964 | Meek | 62/271 X |
| 3,398,510 | 8/1968 | Pennington | 55/208 X |
| 3,470,708 | 10/1969 | Weil et al. | 62/271 |
| 3,708,956 | 1/1973 | Norback | 55/208 X |
| 3,774,374 | 11/1973 | Dufour et al. | 55/388 X |
| 3,828,528 | 8/1974 | Weil | 55/390 X |
| 3,844,737 | 10/1974 | Macriss et al. | 62/271 X |
| 3,889,742 | 6/1975 | Rush et al. | 55/390 X |
| 3,965,695 | 6/1976 | Rush et al. | 62/271 |
| 4,113,004 | 9/1978 | Rush et al. | 62/271 X |
| 4,180,126 | 12/1979 | Rush et al. | 62/271 X |

FOREIGN PATENT DOCUMENTS

| | | | |
|---|---|---|---|
| 2729862 | 1/1978 | Fed. Rep. of Germany | 55/390 |
| 54-35994 | 11/1979 | Japan | 55/181 |

*Primary Examiner*—Lloyd L. King

*Attorney, Agent, or Firm*—Birch, Stewart, Kolasch & Birch

[57] ABSTRACT

An open-cycle type air conditioner includes three major passges; a room air passage defined between a room air inlet and a room air outlet; an outside air passage defined between an outside air inlet and an outside air outlet; and a regenerative air passage defined between a regenerative air inlet and a regenerative air outlet. A room air blower unit is disposed in the room air passage face to face with the room air inlet. A rotary latent heat exchanger which preferably comprises polyester unwoven fiber impregnated with lithium chloride extends over the room air passage and the regenerative air passage with its side walls in a horizontal direction. The rotary latent heat exchanger is located on the downflow side of the regenerative inlet. There is further provided a rotary sensible heat exchanger disposed on the downflow side of the rotary latent heat exchanger in the room air passage and extending over the room air passage and the outside air passage with its side walls disposed in a horizontal direction and being in communication with the outside air outlet. A first rotary filter type humidifier is disposed on the downflow side of the rotary sensible heat exchanger and in the neighborhood of the room air outlet, while a second rotary filter type humidifier is disposed in the outside air passage and in the neighborhood of the outside air inlet. An outside air blower unit is disposed on the downflow side of the second rotary filter type humidifier in the outside air passage and a regenerative air blow unit is disposed on the downflow side of the rotary latent heat exchanger in the regenerative air passage and in the neighborhood of the regenerative air outlet.

9 Claims, 10 Drawing Figures

OPEN-CYCLE TYPE AIR CONDITIONER

BACKGROUND OF THE INVENTION

This invention relates to a structure of an open-cycle type air conditioner including a rotary latent heat exchanger, a rotary sensible heat exchanger, and first and second rotary filter type humidifiers.

Open-cycle air conditioners are well known in the art, for example, as disclosed in U.S. Pat. No. 3,828,528 to Sanford A. Well. However, such air conditioners have serpentine passages for room air and outside air with resultant increase in fluid resistance and increase in power consumption in blower units. furthermore, since the rotary sensible heat exchanger is disposed in a vertical direction, the air conditioners are large as a whole.

OBJECTS AND SUMMARY OF THE INVENTION

Accordingly, it is an object of the present invention to provide an open-circle type air conditioner which minimizes fluid resistance and space requirement.

It is another object of the present invention to provide an open-cycle type air conditioner which exhibits improved humidifying and cooling performance.

It is still another object of the present invention to provide an open-cycle type air conditioner which exhibits dehumidifying performance and provides effective utilization of a heat source as well as a low temperature heat source.

In one preferred form of the present invention, there is provided an open-cycle type air conditioner which comprises a room air passage defined between a room air inlet and a room air outlet, an outside air passage defined between an outside air inlet and an outside air outlet, a regenerative air passage defined between a regenerative air inlet and a regenerative air outlet, a room air blower unit disposed in the room air passage face to face with the room air inlet, a rotary latent heat exchanger extending over the room air passage and the regenerative air passage and having side walls in a horizontal direction, said rotary latent heat exchanger being disposed on the downflow side of the regenerative inlet, a rotary sensible heat exchanger disposed on the downflow side of said rotary latent heat exchanger in the room air passage and extending over the room air passage and the outside air passage, side walls of said rotary sensible heat exchanger being disposed in a horizontal direction and being in communication with the outside air outlet, a first rotary filter type humidifier disposed on the downflow side of said rotary sensible heat exchanger and in the neighborhood of the room air outlet, a second rotary filter type humidifier disposed in the outside air passage and in the neighborhood of the outside air inlet, and outside air blower unit disposed on the downflow side of said second rotary filter type humidifier in the outside air passage, and a regenerative air blower unit disposed on the downflow side of said rotary latent heat exchanger in the regenerative air passage and in the neighborhood of the regenerative air outlet.

BRIEF DESCRIPTION OF THE DRAWINGS

For a more complete understanding of the present invention and for further objects and advantages thereof, reference is now made to the following description taken in conjunction with the accompanying drawings, in which.

DETAILED DESCRIPTION OF THE INVENTION

Figure 1:
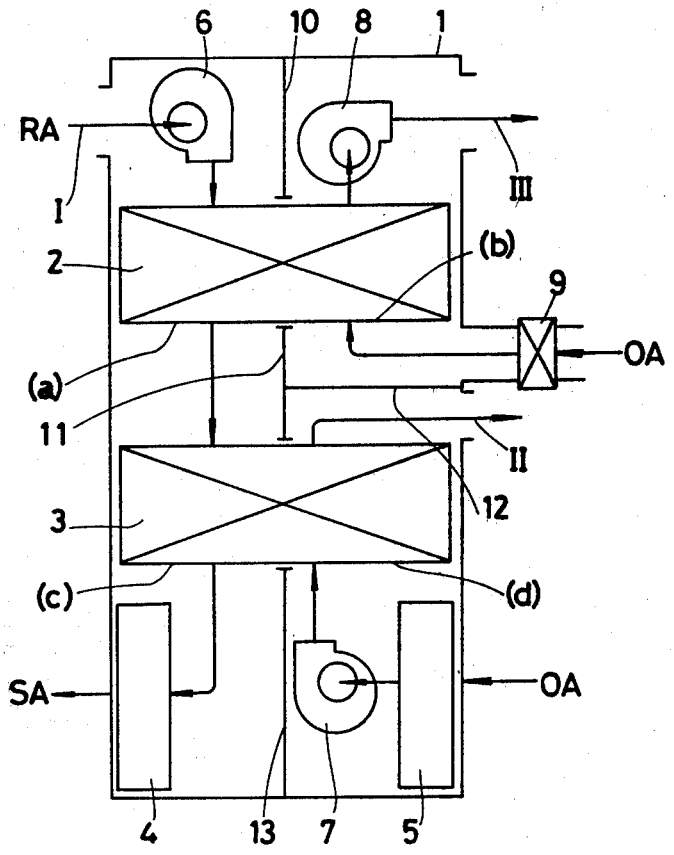
FIG. 1 is a scheme of an open-cycle type air conditioner according to the present invention.

Referring now to FIG. 1, there is illustrated a scheme of an open-cycle type air conditioner according to the present invention. A main body of the air conditioner generally designated 1 is divided into three air passages by use of partition walls 10, 11, 12 and 13, a room air passage I, an outside airpassage II and a regenerative air passage III. A rotary latent heat exchanger 2 is disposed to extend over the room air passage I and the regenerative air passage III an a rotary sensible heat exchanger 3 is disposed to extend over the room air passage I and the outside air passage II. An upper inlet and a lower outlet defining the room air passage I are open to the interior of a room to be air-conditioned. A room air blower unit 6 is disposed at an upper level in the room air passage I to draw room air from the upper inlet and direct the same toward a room air humidifier 4 through the rotary latent heat exchanger 2 and the rotary sensible heat exchanger 3. An outside air blower unit 7 is disposed at a lower level in the outside air passage II to discharge moisture-laden outside air from an outside air humidifier 5 through the rotary sensible heat exchanger 3. A regenerative air blower unit 8 is disposed at an upper level in the regenerative air passage III to feed hot air from a heat source 9 to the rotary latent heat exchanger 2 and to heat and recover the latent heat of exchanger 2. In FIG. 1, the latent heat exchanger 2 has a process region (a) in the room air passage I and a regenerative region (b) in the regenerative passage (III), whereas the sensible heat exchanger 3 has a process region (c) in the room air passage I and an outside air region (d) in the outside air passage II.

The above described air conditioner operates in the following manner. Room air (RA) passes through the rotary latent heat exchanger 2 wherein the room air is dehumidified and heated to an elevated temperature. Within the outside air passage II outside air (OA) is humidified and cooled through the outside air humidifier 5 and then discharged by way of the rotary sensible heat exchanger 3. When passing through the rotary sensible heat exchanger 3, the room air dehumidified and heated past the rotary latent heat exchanger 2 is pre-cooled and further humidified and cooled through the room air humidifier 4. The resulting room air is fed as supply air (SA) into the interior of the room. It is noted that the hot air from the heat source 9 heats and recovers the rotary latent heat of exchanger 2 while traveling the regenerative air passage III and finally leaves the conditioner. The operation of the above air conditioner will be more clearly understood from a review of FIG. 2.

Figure 3:
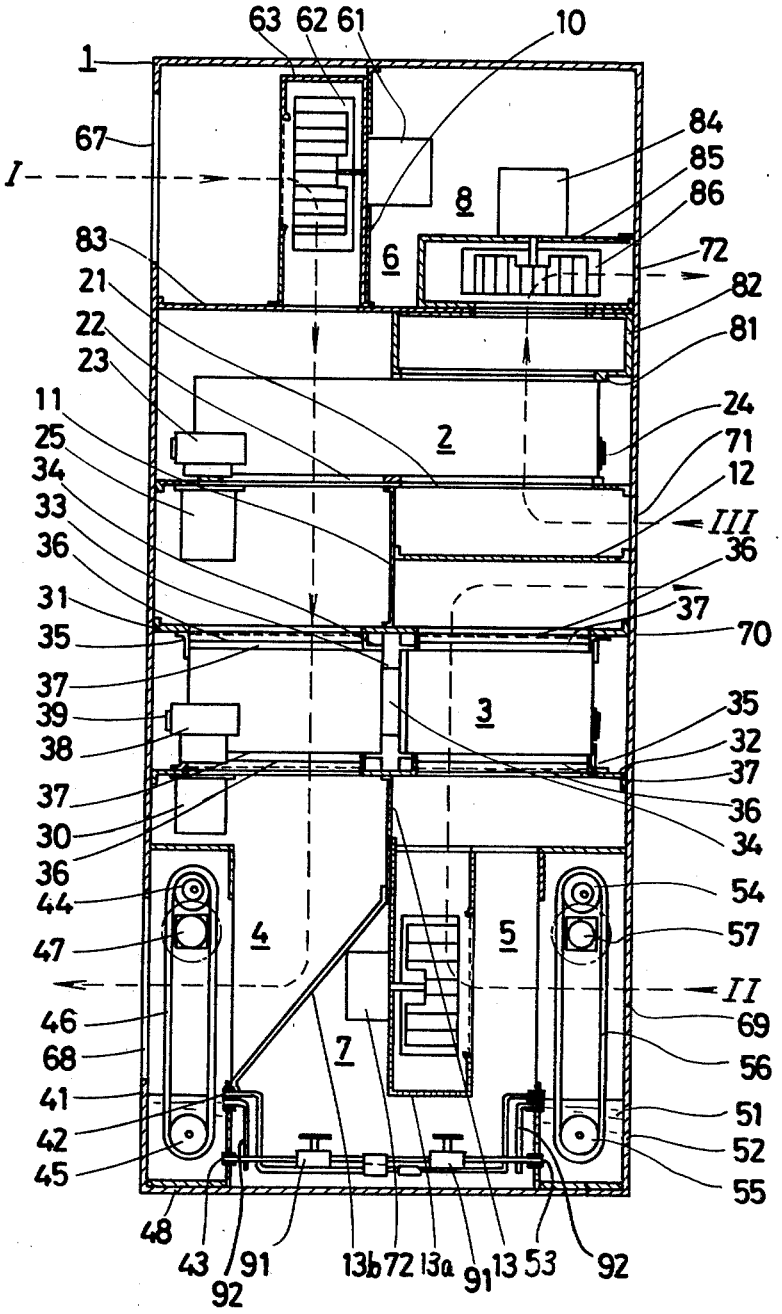
FIG. 3 is an elevational cross-sectional view of details of the open-cycle type air conditioner according to the present invention.

FIG. 3 details the construction of the open-cycle type air conditioner according to the present invention. As set forth above, the room air blower unit 6 is installed in the room air passage I face to face with a room air inlet 67. A room air blower fan 62 is rotated by a blower motor 61 within a blower casing 63. The blower fan 62 is secured on the blower motor 61 which in turn is fixed on the partition wall 10.

The rotary latent heat exchanger 2 is disposed on the downflow side of the room air blower unit 6 to extend over both of the room air passage I and the regenerative air passage III. A side wall of the rotary latent heat exchanger 2 is mounted on a seal member 22 adhered to a support 21 having room air apertures for the rotary latent heat exchanger 2. The rotary latent heat exchanger 2 is driven at a speed of about 20 rph by a driving motor 25 resting on the latent heat exchanger support 21 via a belt 24 which extends between a driving pulley 23 and the rotary latent heat exchanger 2.

On the downflow side of the rotary latent heat exchanger 2, there is provided a top wall 31 having room air apertures and a bottom wall 32 having room air apertures for installation of the rotary sensible heat exchanger 3. The rotary sensible heat exchanger 3 is interposed between the top and bottom walls 31 and 32 with its side wall in a horizontal direction. A shaft 33 of the rotary sensible heat exchanger 3 is journaled within bearings 34 in the both walls 31 and 32. Elastic sealing members 35 are disposed on the periphery of the rotary sensible heat exchanger 3 with its ends being held under pressure on the both walls 31 and 32. Elastic members 37 are held under pressure on the side walls of the rotary sensible heat exchanger 3 by means of angles 36 along the diameter of the rotary sensible heat exchanger 3. The rotary sensible heat exchanger 3 is rotated at a speed of about 15 rpm by a driving motor 30 mounted on the bottom support 32 for the rotary sensible heat exchanger 3 via a driving belt 39 extending between a driving pulley 38 and the rotary sensible heat exchanger 3.

There is provided on the downflow side of the rotary sensible heat exchanger 3 a first rotary filter type humidifier 4 which includes a water reservoir 41 having a supply port 42 and a discharge port 43 and a humidifying filter 46 extending between an upper roll 44 and a lower roll 45. The rotary filter type humidifier 4 is disposed on a bottom wall 48 in the neighboorhood of a room air outlet 68. The humidifying filter 46 is rotated in a vertical direction by a driving motor 47 while its lower portion is dipped in the water reservoir.

Furthermore, the second rotary filter type humidifier 5 is disposed in the outside airpassage II to face an outside air inlet 69, which humidifier includes a water reservoir 51 having a supply port 52 and a discharge port 53 and a humidifying filter 56 extending between an upper roll 54 and a lower roll 55. The second rotary filter type humidifier 5 is disposed on the bottom wall 48. The humidifying filter 56 is rotated in a vertical direction by a driving motor 57 with its lower portion being dipped in the water reservoir 51.

The outside air blower unit 7 is disposed on the downflow side of the humidifier 4 separated by wall **13*b* which unit includes a casing 13*a* mounted on the partition 13 between the room air passage 1 and the outside air passage II and an outside air blower motor 72. As stated previously, the rotary sensible heat exchanger 3 interposed between the bottom wall 32 having outside air apertures and the top wall 31 having outside air apertures extends over the room air passage I. An outside air outlet 70 is formed on the downflow side of the rotary sensible heat exchanger 3. In the passage leading the top wall 31 for the rotary sensible heat exchanger to the outside air outlet 70, there is provided the partition walls 11 and 12** which separates between the outside air passage II and the room air passage I and between the outside air passage II and the regenerative air passage III.

On the downflow side of a regenerative air inlet 71 of the regenerative air passage III, the regenerative air passage III is separated from the room air passage I by the partition wall 11. By use of the bottom wall 21 having regenerative air apertures, the rotary latent heat exchanger 2 is disposed to extend over the room air passage I with its side walls in a horizontal direction. A regenerative duct 82 having regenerative air apertures and a sealing member 81 is urged onto the top wall of the rotary latent heat exchanger 2. The regenerative duct 82 also is provided at its top wall with regenerative air apertures. The top wall of the regenerative duct 82 is held in contact with a partition wall 83 having regenerative air apertures. The regenerative air blower unit 8 including a motor 84, a casing 85 and a blower fan 86 is secured on the partition wall 83. The outlet port of the regenerative air blower unit 8 is open to a regenerative air outlet 72. There is further provided a pair of valves 91 and a pair of overflow drains 92.

Since in the above illustrated open-cycle type air conditioner the rotary latent heat exchanger and the rotary sensible heat exchanger are disposed in a horizontal direction, the air passages become simpler with decreased fluid resistance which in turn leads to decrease in the height and size of the air conditioner.

Figure 4:
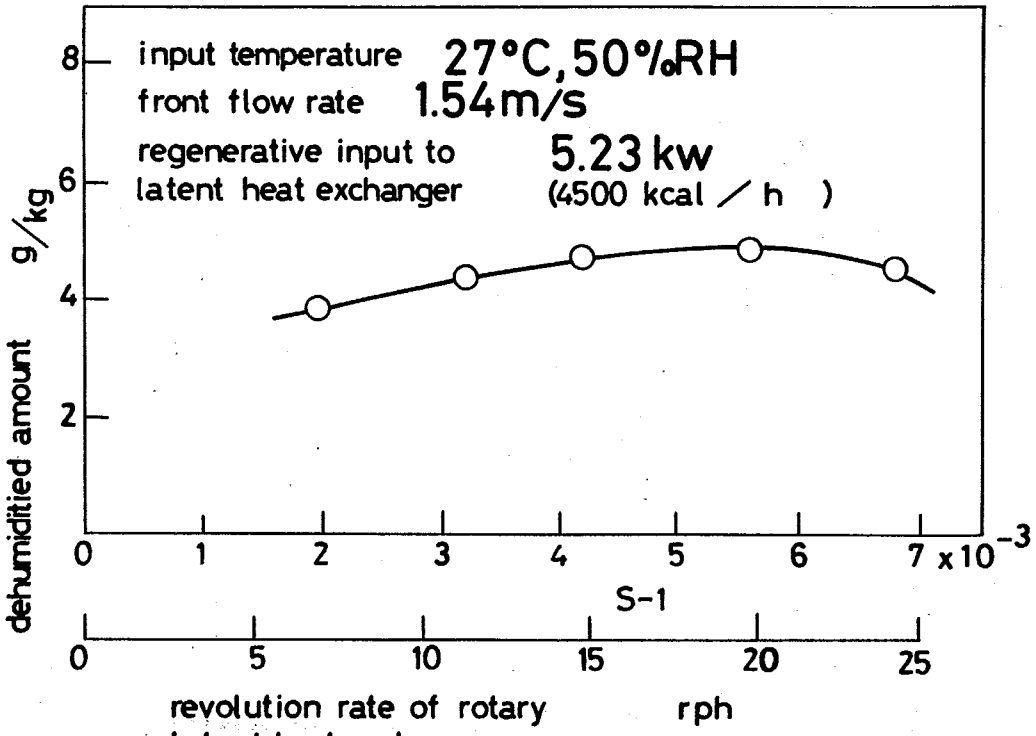
FIG. 4 is a graph showing the relationship between the revolution rate of a rotary latent heat exchanger and dehumidified amount.

Optimum operation of the rotary latent heat exchanger 2 which plays an important role in enhancing the efficiency of the open-cycle type air conditioner can be achieved by optimizing the dehumidifying process. The rotary latent heat exchanger 2 is typically made of polyester un-woven cloth. This is made by rolling up a sheet of corrugated polyester un-woven cloth together with a flat sheet, both 0.10–0.20 mm thick, into a cylindrical drum. Lithium chloride (LiCl) is permeated into a matrix up to 6–10% of its dry weight. Its dehumidified amount varies according to the revolution rate of the heat exchanger 2 as shown in FIG. 4 and reaches its maximum with a revolution rate within the range of 15–25 rph. Especially, the dehumidified amount is the maximum at a revolution rate of 20 rph. It is clear from the foregoing that the rotary latent heat exchanger 2 exhibits excellent performance to guarantee enriched performance of the open-cycle type air conditioner when its revolution rate is selected within the range of 15–25 rph.

Figure 5:
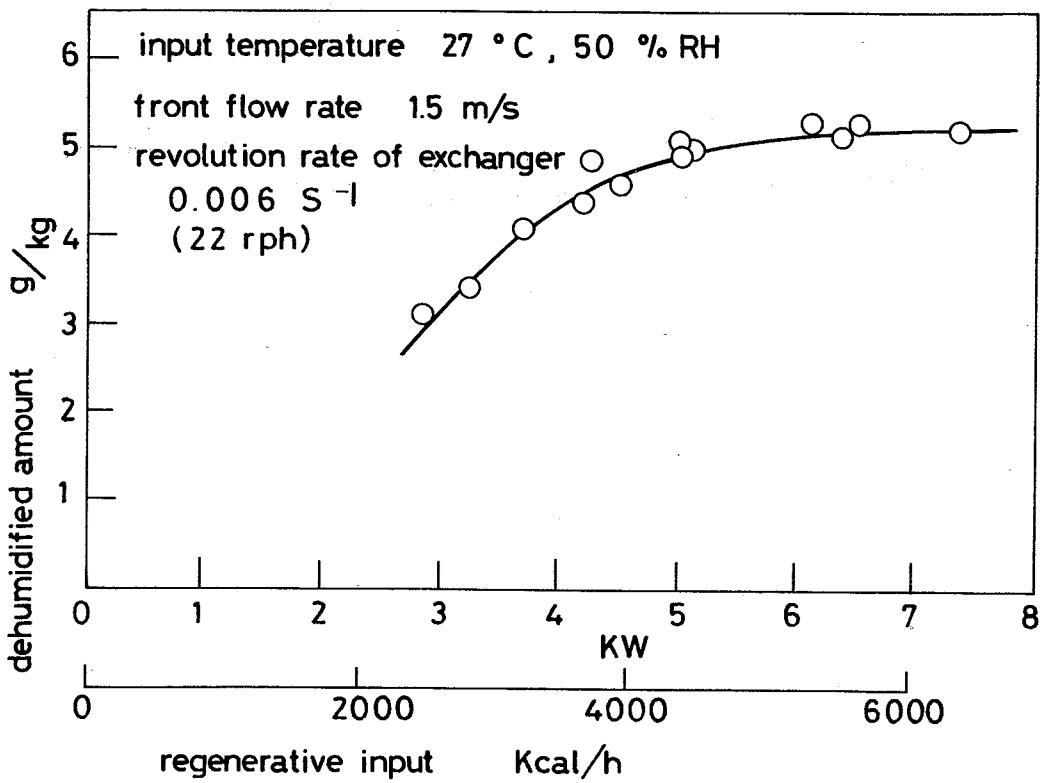
FIG. 5 is a graph showing the relationship between regenerative input and dehumidified amount with regard to the ambient air.

As typically depicted in FIG. 5, the dehumidifying performance of the rotary latent heat exchanger 2 does not vary with the regenerative input as defined by formula (1) unchanged. In the case where a relatively low temperature heat source with small t such as solar heat energy is employed, increased V insures performance competitive with in the case where a high temperature heat source with increased Δt is used.

$$Q=\Delta t\times V\times C_P \quad (1)$$

wherein Q: the regenerative input (K cal/h), Δt: the temperature difference of regenerative air before and after the regenerative heat source (°C.), V: the flow rate of the regenerative air (Kg/h), $C_p$: specific heat of regenerative air (K cal/Kg °C.).

Figure 6:
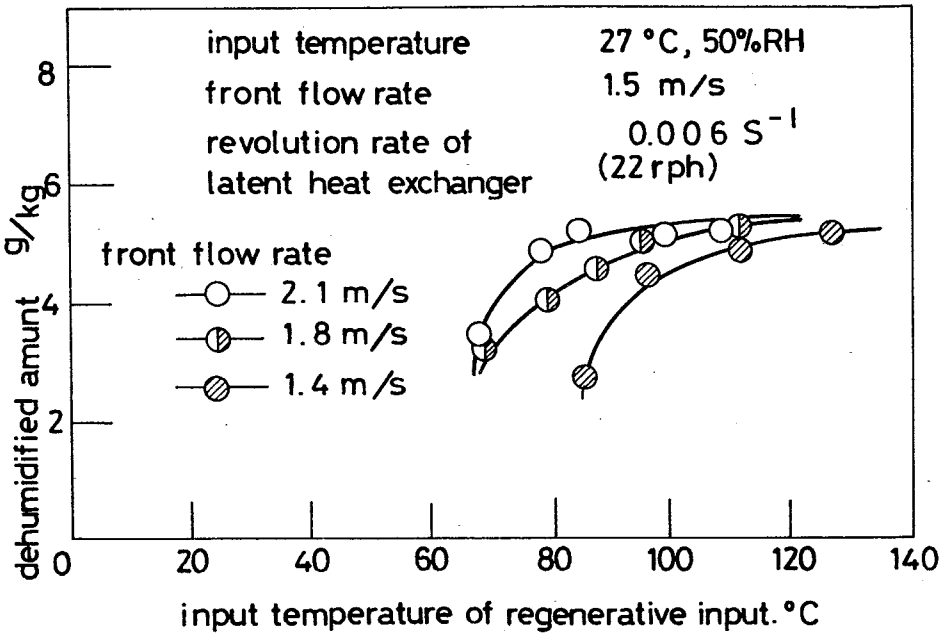
FIG. 6 is a graph showing the relationship between input temperature of regenerative air to a regenerative region of the rotary latent heat exchanger and dehumidified amount as a function of the speed of regenerative air in front of the rotary latent heat exchanger.

As is clear from FIG. 6, when the flow rate of the regenerative air in front of the rotary latent heat exchanger is higher than 2 $m\cdot s^{-1}$, the dehumidified amount becomes saturated with less than 80° C. input teperature of the regenerative air to the regenerative region (b) of the rotary latent heat exchanger. Furthermore, if the flow rate of the regenerative air is less than 1.5 $m\cdot s^{-1}$, then the dehumidified amount is saturated with higher than 100° C. input temperature of the regenerative air to the regenerative region (b) of the rotary latent heat exchanger. If the flow rate of the regenerative air in front of the heat exchanger 2 is within 1.5 $m\cdot s^{-1}$–2.0 $m\cdot s^{-1}$, the dehumidified amount is saturated with the input temperature of the regenerative air to the regenerative region (b) within the range of 80°–100° C.

Excellent dehumidifying performance is available without loss of heat when the input temperature of the regenerative air to the regenerative region (b) is less than 80° C. and its flow rate in front of the rotary latent heat exchanger is more than 2.0 $m\cdot s^{-1}$, when the former is within 80°–100° C. and the latter is 1.5 $m\cdot s^{-1}$–2.0 $m\cdot s^{-1}$ and when the former is more than 100° C. and the latter is less than 1.5 $m\cdot s^{-1}$, respectively.

Figure 7:
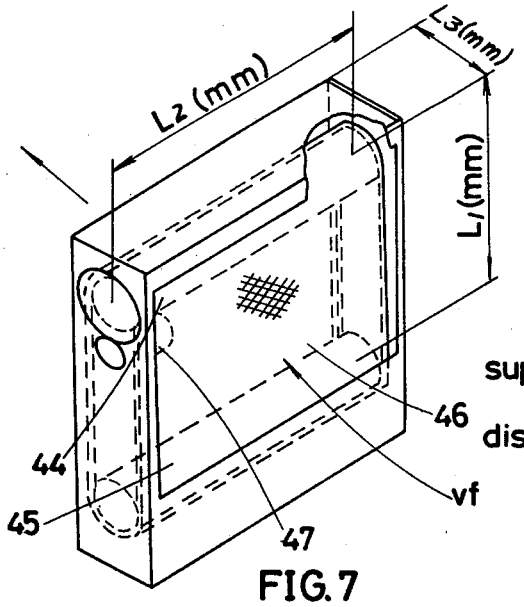
FIG. 7 is a perspective view of a rotary filter type humidifier used in the air conditioner in FIG. 3.
Figure 8:
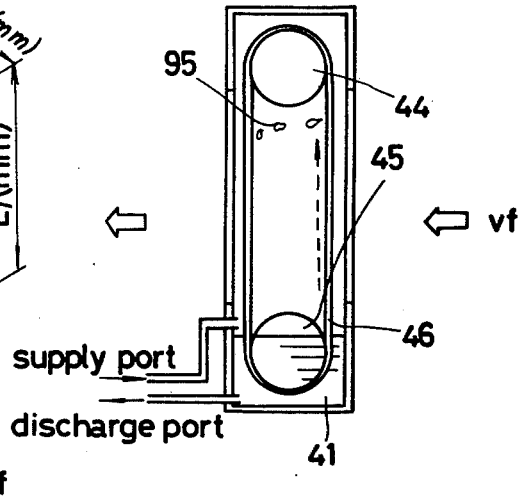
FIG. 8 is an elevational cross-sectional view of the rotary filter type humidifier.

As mentioned above, the humidifiers 4 and 5 in the air conditioner of FIG. 3 are of the rotary filter type as shown in FIGS. 7 and 8. The filter 46 is made of nylon, highly permeable to air and of a circular shape extending between the rolls 44 and 45. Therefore, the humidifier is easy to assemble and its efficiency is determined by the flow rate $v_f$ of air passing therethrough. Provided that an effective area of the filter 46 is ensured, the longitudinal and lateral dimensions $L_1$ and $L_2$ of the humidifiers are optionally selectable. Moreover, since the depth $L_3$ of the humidifiers may be sufficiently small, these humidifiers demand a minimum of space when being assembled into the air conditioner. In the case where the filter 46 is rotated in the direction of the dotted arrow with regard to the flow of air as depicted in FIG. 8, the filter itself prevents water drops from being scattered.

Figure 9:
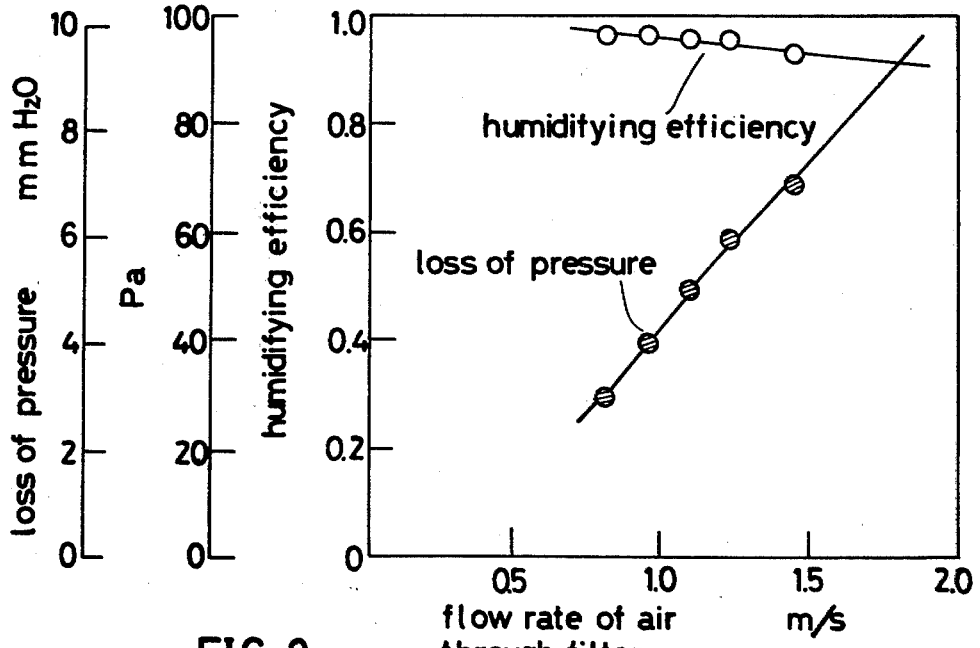
FIG. 9 is a graph showing the relationship between the flow rate of air passing through a filter and efficiency of humidifying and loss of pressure.

FIG. 9 indicates that the efficiency of the humidifiers 4 and 5 and loss of pressure depend on the flow rate $v_f$ of air passing through the filter. In FIG. 9, $P_a$ is Pascal as unit of pressure indicative of degree of pressure loss like mm $H_2O$. The humidifying efficiency can be written as follows:

$$(X-X_0)/(X_1-X_0)$$

wherein $X_0$: the humidity of air before passing through the humidifier (g/Kg), $X_1$: the moisture of air humidified to 100% RH after passing through the humidifier (g/Kg), and X: the moisture of air after passing the humidifier (g/Kg).

Figure 10:
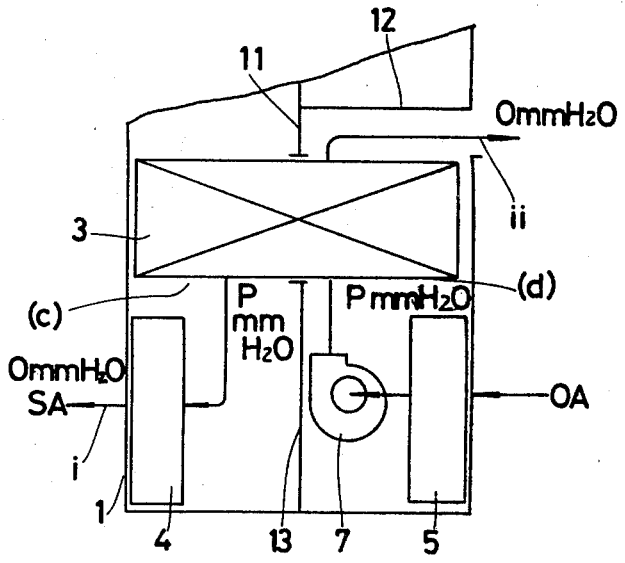
FIG. 10 is a graph showing static pressure at a lower portion of a rotary sensible heat exchanger in the open-cycle type air conditioner.

In the scheme of FIG. 1, static pressure at the partition wall 13 or the boundary between the room and the ambient atmosphere at the bottom of the rotary sensible heat exchanger 3 is developed as shown in FIG. 10. The amount of leaking air from the partition wall 13 is determined as a function of the pressure difference $P_1-P_2$ and it is desirable that such pressure difference be as small as possible. In other words, decreased loss of pressure in the room air humidifier 4 and decreased loss of pressure in the outside air region (d) of the rotary sensible heat exchanger permit the decreasing of the amount of the leaking air. Generally, the rotary sensible heat exchanger 3 for use in the open-cycle type air conditioner operates with loss of pressure on the order of 5–10 mm $H_2O$. For example, when the effective area of the filter 46 is selected such that the flow rate $v_f$ of air passing through the filter 46 in the humidifier falls within the range of 1.0–2.0 $m\cdot s^{-1}$, loss of pressure amounts to 4–10 mm $H_2O$) with little or no pressure difference with regard to the outside air region (d) of the rotary sensible heat exchanger. At the same time the humidifying efficiency is significantly high, typically more than 90%. It is well known in the art that the optimum flow rate in the air conditioner is determined essentially by the cooling capacity. For this reason, if the flow rate of the air passing through the filter is selected to be higher than 2.0 $m\cdot s^{-1}$, the air permeablity of the filter should be kept high and the efficiency drops below 90%. One possible approach to maintain efficiency of more than 90% is to deteriorate the permiability of the filter to a permissible extent. However, this results in increasing loss of pressure over 10 mm $H_2O$. In any case, the air conditioner becomes very large and inferior in efficiency due to loss of pressure unless the flow rate is between 1.0 $m\cdot s^{-1}$ and 2.0 $m\cdot s^{-1}$.

Figure 2:
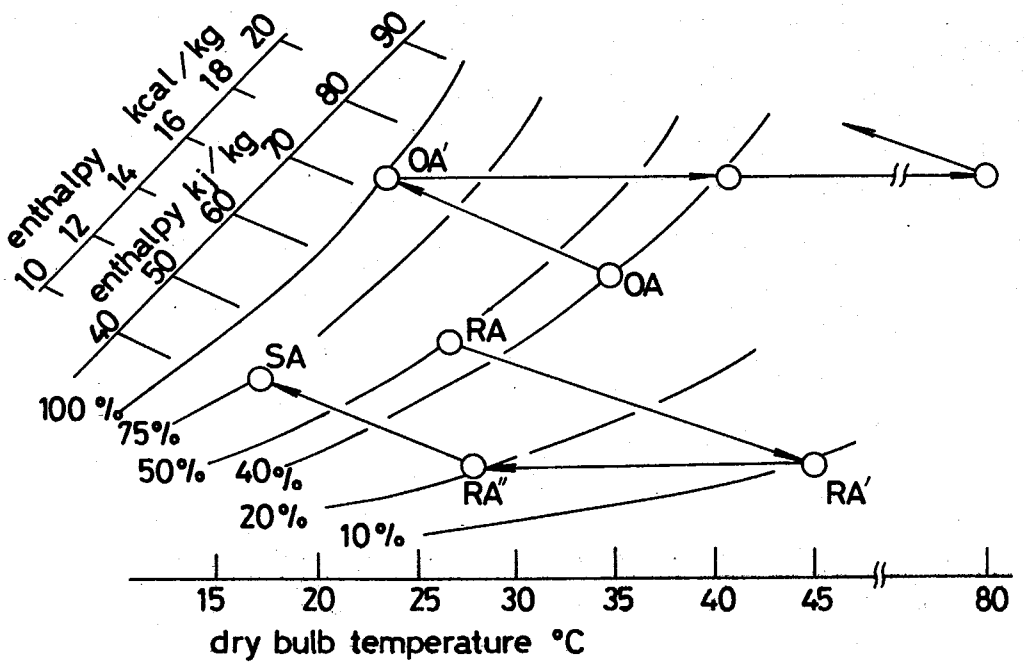
FIG. 2 is a graph for explanation of the operating principle of the open-cycle type air conditioner of FIG. 1.

It is preferable that the enthalpy of RA″ be as small as possible in order to improve the efficiency of the open-cycle type air conditioner as seen from FIG. 2. The enthalpy of RA″ is determined by OA′ and RA′. The more OA′ is kept close to 100% RH, the smaller is the enthalpy of RA″. In FIG. 2, the designation OA′ means the humidified and cooled outside air, RA′ means the dehumidified room air and RA″ means the dehumidified and pre-cooled room air.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An open-cycle type air conditioner comprising:

a room air passage defined between a room air inlet and a room air outlet;

an outside air passage defined between an outside air inlet and an outside air outlet;

a regenerative air passage defined between a regenerative air inlet and a regenerative air outlet;

a room air blower unit disposed in the room air passage to face to face with the room air inlet;

a rotary latent heat exchanger extending over the room air passage and the regenerative air passage and having side walls in a horizontal direction, said rotary latent heat exchanger being disposed on the downflow side of the regenerative inlet;

a rotary sensible heat exchanger disposed on the downflow side of said rotary latent heat exchanger in the room air passage and extending over the room air passage and the outside air passage, side walls of said rotary sensible heat exchanger being disposed in a horizontal direction and being in communication with the outside air outlet;

a first rotary filter type humidifier disposed on the downflow side of said rotary sensible heat exchanger and in the neighborhood of the room air outlet;

a second rotary filter type humidifier disposed in the outside air passage and in the neighborhood of the outside air inlet;

an outside air blower unit disposed on the downflow side of said second rotary filter type humidifier in the outside air passage; and a regenerative air blower unit disposed on the downflow side of said rotary latent heat exchanger in the regenerative air passage and in the neighborhood of the regenerative air outlet.

2. An open-cycle type air conditioner as set forth in claim 1 wherein said rotary latent heat exchanger includes polyester un-woven fiber.

3. An open-cycle type air conditioner as set forth in claim 2 wherein said polyester un-woven fiber is 0.10–0.20 mm thick and impregnated with lithium chloride up to 6–10% of its dry weight.

4. An open-cycle type air conditioner as set forth in claim 3 wherein said rotary latent heat exchanger is drived at a rotation rate of 15–25 rph.

5. An open-cycle type air conditioner comprising:

a room air passage extending from a room air inlet to a room air outlet through a room air blower unit, a process region of a rotary latent heat exchanger, a process region of a rotary sensible heat exchanger and a room air humidifier;

a regenerative air passage extending from a regenerative air source to a regenerative air outlet through a regenerative air inlet, a regenerative region of said rotary latent heat exchanger and a regenerative air blower unit; and an outside air passage extending from an outside air inlet to an outside air outlet through an outside air humidifier, an outside air blower unit and an outside air region of said rotary sensible heat exchanger, wherein said rotary latent heat exchanger comprises 0.10–0.20 mm thick polyester un-woven fiber impregnated with lithium chloride up to 6–10% of its dry weight, and said rotary latent heat exchanger is driven at a rotation rate within 15–25 rph.

6. An open-cycle type air conditioner comprising:

a room air passage extending from a room air inlet to a room air outlet through a room air blower unit, a process region of a rotary latent heat exchanger, a process region of a rotary sensible heat exchanger and a room air humidifier;

a regenerative air passage extending from a regenerative air source to a regenerative air outlet through a regenerative air inlet, a regenerative region of said rotary latent heat exchanger and a regenerative air blower unit; and an outside air passage extending from an outside air inlet to an outside air outlet through an outside air humidifier, an outside air blower unit and an outside air region of said rotary sensible heat exchanger, wherein said rotary latent heat exchanger comprises 0.10–0.20 mm thick polyester un-woven fiber impregnated with lithium chloride up to 6–10% of its dry weight, and said rotary latent heat exchanger is driven at a rotation rate within 15–25 rph, and wherein the flow rate of regenerative air in front of said rotary latent heat exchanger is higher than 2 $m \cdot s^{-1}$ when the temperature of the regenerative air supplied to said regenerative region of said rotary latent heat exchanger is less than 80° C.

7. An open-cycle type air conditioner comprising:

a room air passage extending from a room air inlet to a room air outlet through a room air blower unit, a process region of a rotary latent heat exchanger, a process region of a rotary sensible heat exchanger and a room air humidifier;

a regenerative air passage extending from a regenerative air source to a regenerative air outlet through a regenerative air inlet, a regenerative region of said rotary latent heat exchanger and a regenerative air blower unit; and an outside air passage extending from an outside air inlet to an outside air outlet through an outside air humidifier, an outside air blower unit and an outside air region of said rotary sensible heat exchanger, wherein said rotary latent heat exchanger comprises 0.10–0.20 mm thick polyester un-woven fiber impregnated with lithium chloride up to 6–10% of its dry weight, and said rotary latent heat exchanger is driven at a rotation rate within 15–25 rph, and wherein the flow rate of regenerative air in front of said rotary latent heat exchanger is between 1.5 $m \cdot s^{-1}$ and 2.0 $m \cdot s^{-1}$ when the temperature of the regenerative air supplied to said regenerative region of said rotary latent heat exchanger is between 80° C. and 100° C.

8. An open-cycle type air conditioner comprising:

a room air passage extending from a room air inlet to a room air outlet through a room air blower unit, a process region of a rotary latent heat exchanger, a process region of a rotary sensible heat exchanger and a room air humidifier;

a regenerative air passage extending from a regenerative air source to a regenerative air outlet through a regenerative air inlet, a regenerative region of said rotary latent heat exchanger and a regenerative air blower unit; and an outside air passage extending from an outside air inlet to an outside air outlet through an outside air humidifier, an outside air blower unit and an outside air region of said rotary sensible heat exchanger, wherein said rotary latent heat exchanger comprises 0.10–0.20 mm thick polyester un-woven fiber impregnated with lithium chloride up to 6–10% of its dry weight, and said rotary latent heat exchanger is driven at a rotation rate within 15–25 rph, and wherein the flow rate of regenerative air in front of said rotary latent heat exchanger is lower than 1.5 $m \cdot s^{-1}$ when the temperature of the regenerative air supplied to said regenerative region of said rotary latent heat exchanger is higher than 100° C.

9. An open-cycle type air conditioner comprising:

a room air passage extending from a room air inlet to a room air outlet through a room air blower unit, a process region of a rotary latent heat exchanger, a process region of a rotary sensible heat exchanger and a room air humidifier;

a regenerative air passage extending from a regenerative air source to a regenerative air outlet through a regenerative air inlet, a regenerative region of said rotary latent heat exchanger and a regenerative air blower unit; and an outside air passage extending from an outside air inlet to an outside air outlet through an outside air humidifier, an outside air blower unit and an outside air region of said rotary sensible heat exchanger, wherein said room air humidifier and said outside air humidifer each comprises a nylon filter rotated by a motor and the flow rate of air passing through each of said filters is between 1.0 and 2.0 $m \cdot s^{-1}$ and the filter of said outside air humidifier is driven at a rotation rate of more than 1.5 rpm.

* * * * *